US008063841B2

(12) United States Patent
Peng et al.

(10) Patent No.: US 8,063,841 B2
(45) Date of Patent: Nov. 22, 2011

(54) WIDEBAND HIGH GAIN DIELECTRIC NOTCH RADIATOR ANTENNA

(76) Inventors: Sheng Peng, Murrietta, CA (US); Henry Cooper, Murrieta, CA (US)

( * ) Notice: Subject to any disclaimer, the term of this patent is extended or adjusted under 35 U.S.C. 154(b) by 310 days.

(21) Appl. No.: 12/419,213

(22) Filed: Apr. 6, 2009

(65) Prior Publication Data

US 2009/0251377 A1 Oct. 8, 2009

Related U.S. Application Data

(60) Provisional application No. 61/075,296, filed on Jun. 24, 2008, provisional application No. 61/118,549, filed on Nov. 28, 2008, provisional application No. 61/042,737, filed on Apr. 5, 2008, provisional application No. 61/042,752, filed on Apr. 6, 2008.

(51) Int. Cl.
*H01Q 13/10* (2006.01)
*H01Q 13/00* (2006.01)

(52) U.S. Cl. ..... 343/767; 343/770; 343/786

(58) Field of Classification Search ..... 343/767, 343/770, 786, 795; 29/600
See application file for complete search history.

(56) References Cited

U.S. PATENT DOCUMENTS 5,541,611 A * 7/1996 Peng et al. ..... 343/767
5,845,391 A * 12/1998 Bellus et al. ..... 29/600
7,557,755 B2 * 7/2009 Han et al. ..... 343/700 MS

* cited by examiner

*Primary Examiner* — Hoang V Nguyen
(74) *Attorney, Agent, or Firm* — Donn K. Harms

(57) ABSTRACT

A radiator element for RF transmission and reception over a wide band of frequencies. The radiator element is formed of conductive material on substrate surface of conductive material in the form of a pair of horns extending in opposite directions to distal tips defining the widest distance of a mouth of a cavity. The mouth reduces in cross-section to a narrowest point in between said pair of horns. The resulting radiator element will radiate and receive frequencies between frequencies the distance of the widest point and narrowest point are sized to receive.

13 Claims, 6 Drawing Sheets

WIDEBAND HIGH GAIN DIELECTRIC NOTCH RADIATOR ANTENNA

This application claims priority to U.S. Provisional Application 61/075,296 filed Jun. 24, 2008 and U.S. Provisional Application 61/118,549 filed Nov. 28, 2008, and U.S. Provisional Application 61/042,737 filed Apr. 5, 2008, and U.S. Provisional Application 61/042,752 filed Apr. 6, 2008, all four of which are incorporated herein in their entirety by reference.

BACKGROUND OF THE INVENTION

1. Field of the Invention

The present invention relates to antennas for transmission and reception of radio frequency communications. More particularly to an antenna employing planar shaped radiator elements, which are employable individually, or engageable to other similarly configured radiator elements, for both increased gain, steerability. The radiator elements are capable of concurrent communications between users and adjacent antenna nodes having the same radiator elements in one or a wide variety of bandwiths. The unique configuration of the individual antenna radiator elements provides excellent transmission and reception performance in a wide band of frequencies between 470 MHz to 5.8 GHz. Such performance in such a wide bandwidth is heretofore un-achieved and the single radiator element disclosed is capable of employment for reception and transmission in widely used civilian and military frequencies such as 700 MHz, 900 MHz, 2.4 GHz, 3.5 GHz, 3.65 GHz, 4.9 GHz, 5.1 GHz and 5.8 GHz. The radiator element actually has reasonable performance capabilities up to 1.2 gbps rendering it capable of deployment for antenna towers for concurrent reception and transmission of RF frequencies between 470 MHz to 5.8 GHz which is heretofore unachievably in a single antenna element. Such deployment will minimize the number of towers and antennas needed in a grid or communications web yet provide for the maximum number of different types of communications from cellular phones to HDTV.

2. Prior Art

Conventionally, cellular, radio, and television antennas are formed in a structure that may be adjustable for frequency and gain by changing the formed structure elements. Shorter elements for higher frequencies, longer elements for lower, and pluralities of similarly configured shorter and longer elements to increase gain or steer the beam. However, the formed antenna structure or node itself, is generally fixed in position, but for elements which may be adjusted for length or angle to better transmit and receive on narrow band of frequencies of choice in a location of choice to serve certain users of choice. Because many communications firms employ many different frequencies, many different such individual antenna towers are required with one or a plurality of such towers having radiator elements upon them to match the individual frequencies employed by the provider for different services such as WiFi or cellular phones or police radios. This can result in multiple antenna towers, within yards of each other, on a hill, tall towers or other high points servicing surrounding areas. Such duplication of effort is not only expensive, it tends to be an eyesore in the community.

As such, when constructing a communications array such as a cellular antenna grid, or a wireless communications web, the builder is faced with the dilemma of obtaining antennas that are customized by providers for the narrow frequency to be serviced. Most such antennas are custom made using radiator elements to match the a narrow band of frequencies to be employed at the site which can vary widely depending on the network and venue. Also, a horizontal, vertical, or circular polarization scheme that may be desired to either increase bandwidth or connections. Further consideration must be given to the gain at the chosen frequency and thereafter the numbers elements included in the final structure to meet the gain requirements and possible beam steering requirements.

However, such antennas once manufactured to specific individual frequencies or narrow frequency bands, offer little means of adjustment of their ultimate frequency range, and their gain since they are general fixed in nature. Further, since they are custom manufactured to the frequency band, gain, polarization, beam width, and other requirements, should technology change or new frequencies become available, it can be a problem since new antennas are required to mach the changes.

Still further, for a communications system provider working on many different bands, with many frequencies, in differing wireless cellular or grid communications schemes, a great deal of inventory of the various antennas for the plurality of frequencies employed at the desired gains and polarization schemes must be maintained. Without stocking a large inventory of antennas, delays in installation can occur.

Such an inventory requirement increases costs tremendously as well as deployment lead time if the needed antenna configuration is not at hand. Further, during installation, it is hard to predict the final antenna construction configuration since in a given topography what works on paper may not work in the field. Additionally, what exact gain and polarization or frequency range which might be required for a given system, when it is being installed might not match predications. The result being that a delay will inherently occur where custom antennas must be manufactured for the user if they are not stocked.

This is especially true in cases where a wireless grid or web is being installed for a wireless communications. The frequencies can vary widely depending on the type of wireless communications being implemented in the grid, such as cellular or WiFi or digital communications for emergency services. The system requirements for gain, and individual employed frequencies can also vary depending on the FCC and client's needs.

Still further, the infrastructure required for conventional cellular and radio and other antennas, requires that each antenna be hard-wired to the local communications grid. This not only severely limits the location of individual antenna nodes in such a grid, it substantially increases the costs since each antenna services a finite number of users and it must be hardwired to a local network on the ground.

As such, there is a continuing unmet need for an improved antenna radiator element, and a method of antenna tower or node construction, allowing for easy formation and configuration of a radio antenna for two way communications such as cellular or radio for police or emergency services. Such a device would best be modular in nature and employ individual radiator elements which provide a very high potential for the as-needed configuration for frequency, polarization, gain, direction, steering and other factors desired, in an antenna grid servicing multiple but varying numbers of users over a day's time.

Such a device should employ a wideband radiator element allowing for a standardized number of base components adapted for engagement to mounting towers and the like. The components so assembled should provide electrical pathways to electrically communicated in a standardized connection to transceivers. Such a device, should employ a single radiator element capable of providing for a wide range of different frequencies to be transmitted and received. Such a device by using a plurality of individual radiator elements of substantially identical construction, should be switchable in order to increase or decease gain and steer the individual communications beams.

Employing a plurality of individual wideband radiator elements, such a device should enable the capability of forming antenna sites using a kit of individual radiator element components, each of which are easily engageable with the base components. These individual radiator element components should have electrical pathways which easily engage those of the base components of the formed antenna, to allow for a snap-together or other easy engagement to the base components hosting the radiator elements. Such a device should be capable of concurrently achieving a switchable electrical connection from each of the individual radiator elements, across the base components, and to the transceiver in communication with one or a plurality of the radiator elements.

SUMMARY OF THE INVENTION

The device and method herein disclosed and described achieves the above-mentioned goals through the provision of a single radiator antenna element which is uniquely shaped to provide excellent transmission and reception capability in a wideband of frequencies between 470 MHz to 5.8 GHz.

In the range between 470-860 MHZ, the radiator element disclosed provides excellent performance with a measured loss below −9.8 db which means that the Voltage Standing Wave Radio is 2:1 over this entire frequency band. In the 680 MHz to 2100 MHZ band, the radiator element can concurrently provide excellent performance with a measured return loss of less than −9.8 dB. Similar concurrent performance characteristics are achieved in the bandwidth between 2.0 GHz to 6.0 Ghz. Consequently the single radiator element herein disclosed is capable of concurrent reception and transmission in frequencies from 470 MHz to 5.8 GHz, can be coupled and easily matched for inductance from an array coupling effect, and can provide the wideband communications reception and transmission needed for the 21$^{st}$ Century.

While employable in individual elements, the radiator element may also be coupled into arrays for added gain and beam steering. The arrays may be adapted for multiple configurations using software adapted to the task of switching between radiator elements to form or change the form of engaged arrays of such elements. Using radiator elements each substantially identical to the other, and each capable of RF transmission and reception across a wide array of frequencies to form an array antenna, the device provides an elegantly simple solution to forming antennas which are highly customizable for frequency, gain, polarization, steering, and other factors, for that user.

The radiator element of the instant invention is based upon a planar antenna element formed by printed-circuit technology. The antenna is of two-dimensional construction forming what is known as a horn or notch antenna type. The element is formed on a dialectic substrate of such materials as MYLAR, fiberglass, REXLITE, polystyrene, polyamide, TEFLON, fiberglass or any other such material suitable for the purpose intended. The substrate may be flexible whereby the antenna can be rolled up for storage and unrolled into a planar form for use. Or, in a particularly preferred mode of the device herein, it is formed on a substantially rigid substrate material in the planar configuration thereby allowing for components that both connect, and form the resulting rigid antenna structure.

The antenna radiator element itself, formed on the substrate, can be any suitable conductive material, as for example, aluminum, copper, silver, gold, platinum or any other electrical conductive material suitable for the purpose intended. The conductive material forming the element is adhered to the substrate by any known technology.

In a particularly preferred embodiment, the antenna radiator element conductive material coating on a first side of the substrate is formed with a non-plated first cavity or covered surface area, in the form of a horn. The formed horn has the general appearance of a cross-section of a "whale tail" with two leaves or tail half-sections, in a substantially mirrored configuration, extending from a center to pointed tips positioned a distance from each other at their respective distal ends. Optionally but preferred mirrored "L" shaped extensions extend from those distal positioned tips. These extensions while optional, have been found to significantly enhance performance of the antenna radiator element at lower frequency ranges.

A cavity beginning with a large uncoated or unplated surface area of the substrate between the two halves, forms a mouth of the antenna and is substantially centered between the two distal tip points on each leaf or half-section of the tail shaped radiator element. The cavity extends substantially perpendicular to a horizontal line running between the two distal tip points and then curves into the body portion of one of the tail halves and extends away from the other half.

Along the cavity pathway, from the distal tip points of the element halves, the cavity narrows slightly in its cross sectional area. The cavity is at a widest point between the two distal end points and narrows to a narrowest point. The cavity from this narrow point curves to extend to a distal end within the one tail half, where it makes a short right angled extension from the centerline of the curving cavity.

The widest point of the cavity between the distal end points of the radiator halves, determines the to low point for the frequency range of the element. The narrowest point of the cavity between the two halves determines the highest frequency to which the element is adapted for use. Currently the widest distance is between 1.4 and 1.6 inches with 1.5812 inches being a particularly preferred widest distance. The narrowest point is between 0.024 and 0.026 inches with 0.0253 being particularly preferred when paired with the 1.5812 wide distance. Of course those skilled in the art will realize that by adjusting the widest and narrowest distances of the formed cavity, the element may be adapted to other frequency ranges, and any antenna element which employs two substantially identical leaf portions to form a cavity therebetween with maximum and minimum widths is anticipated within the scope of the claimed device herein.

On the opposite surface of the substrate from the formed radiator element, a feedline extends from the area of the cavity intermediate the first and second halves of the radiator element and passes through the substrate to a tap position to electrically connect with the radiator element which has the cavity extending therein to the distal end perpendicular extension.

The location of the feedline connection, the size and shape of the two halves of the radiator element, and the crossectional area of the cavity, may be of the antenna designers choice for best results for a given use and frequency. However because of the disclosed radiator element performs so well and across such a wide bandwidth, the current mode of the radiator element as depicted herein, with the connection point shown, is especially preferred. Of course those skilled in the art will realize that shape of the half-portions and size and shape of the cavity may be adjusted to increase gain in certain frequencies or for other reasons known to the skilled, and any and all such changes or alterations of the depicted radiator element as would occur to those skilled in the art upon reading this disclosure are anticipated within the scope of this invention.

The radiator element as depicted and described herein performs admirably across many frequencies and spectrums employed by individuals, government, and industry, and is as such a breakthrough in antenna element design. Currently performance is shown by testing to excel in a range of frequencies including but not limited to 700 MHz, 900 MHz, 2.4 GHz, 3.5 GHz, 3.65 GHz, 4.9 GHz, 5.1 GHz and 5.8 GHz with bandwidth capabilities up to 1.2 gbps. Such a wide range in the RF spectrum from a single radiator element is unheard of, prior to this disclosure.

Because of this unique shape rendering the radiator element adept at transmitting and receiving across many frequencies, each such radiator element is easily combined with others of identical shape, to increase gain and steer the beam of the formed antenna.

To that end, in employing a plurality of the disclosed radiator elements to form an array antenna, the device employs a plurality of base or vertical board members each of which are configured with electrical pathways terminating at connector points to provide electrical communication between one or a plurality of the engageable antenna radiator elements, and wired connectors communicating with a transmitter, receiver, or transceiver. One or a plurality of the vertical board members arranged in parallel, are adapted to engage slits in the substrate of the radiator element to thereby provide registered points of engagement for the electrical connection with horizontal substrate members on which antenna radiator elements are formed and positioned. The vertical board members may also have antenna radiator elements positioned thereon generally on a side surface opposite the side surface of the electrical pathways or on a layer insulated from the pathways.

In the modular kit of components, the vertical or base board members would be adapted to engage a mount which registers the terminals of the electrical pathways in an electrical engagement to conductors communicating with the transmission and reception equipment. At the other end of the electrical pathways are connection points that engage with antenna radiator elements on the base member or might be placed to register in engagement with pathways leading to the antenna elements, on horizontal board members.

Engagement of the elements on their respective substrates is accomplished by slits in the vertical board members sized to engage with notches in the horizontal board members providing the mount for the horizontally disposed radiator elements of the antennas. Engaging the slits with the notches will automatically align the horizontal board members carrying the antenna radiator elements into an array with connection points on the secondary base members or with the electrical pathways on the vertical board members.

The horizontal board members may have antennas formed or engaged thereon which are adapted to virtually any frequency desired by the user. However, because as noted, the disclosed radiator element provides such strong two-way communications across such a large spectrum, such is preferred over conventionally formed radiator elements. Thus, a kit of horizontal board members, each with the disclosed radiator elements mounted thereon, being inherently dimensioned for operation at different frequencies, will allow a user to assemble the modular parts into a large array antenna adaptable to the frequency desired from the spectrum made available by the radiator elements unique construction and form.

The horizontal radiator elements engaged to the base members have slits at a projecting rear portion which provide a connection point to an element connection. The secondary board members having electrical pathways thereon, have mating connection points such that engaging the secondary board with the horizontal substrate will connect all of the horizontal antenna radiator elements to connectors leading to the radio equipment. The secondary boards by changing the paths of the electrical pathways formed thereon, can engage the elements in combination with the transceiver, or, can provide isolation of each element and a connection to the transceiver. Pathway changes may be physical for permanent changes or by switching means placed along the conductors and controlled by a computer or user.

Antenna radiator elements formed on the vertical or base member substrate when engaged to a tower in an array in a generally vertical position will provide for vertical polarization while the antenna radiator elements engaged to the horizontal board member substrate in an array will provided for horizontal polarization. Employing both horizontal and vertical radiator elements in the same frequency with appropriate electrical pathways to each other and to the transceiver may provide for a circular polarization to be achieved.

Or, broadcast and reception of signals on the same or different frequencies can be achieved by assembling horizontal board members with antennas adapted to one or more frequencies with the vertical board members having antennas dimensioned to operate at one or more other frequencies.

The resulting formed antenna array structure which resembles a sorting box, is thus highly customizable to the task at hand by simply choosing horizontal and vertical board members having antenna radiator elements thereon adapted to the frequency needed. Because all the parts are adapted to engage and connect the antennas to electrical pathways communicating with the transmission and broadcast equipment, installation to a standardized mount of the vertical board members will allow for easy installation and adjustment in the field for users.

Gain may be increased or decreased by the parallel or independent connections between adjacent horizontal and vertical disposed antenna radiator elements on the respective horizontal and/or vertical substrates forming board members. Combining two vertically disposed antenna radiator elements on different board members, into a larger array will increase the gain, and adding a third or fourth will increase it more. This can be done easily by switching or connecters which engage or separate the pathways leading from the antenna radiator elements, to the transmission and reception equipment.

Steering of the beamwidth of the formed antenna array of individual radiator elements may be adjusted in the same manner using switch engaged horizontal and vertically disposed radiator elements to achieve the ground pattern in either a horizontal, vertical, or circular polarization. Electronic switching by computer would be the best current mode to insure maximum gain and preferred steerability by the formed antenna array. Junction points of the pathways on the horizontal board members to the pathways on the secondary base members may thus be joined, for increasing gain, or provided as separate pathways to the transceiver with the same or different elements to increase the number of frequencies available or reduce gain.

When formed in a series of adjacent rectangular cavities steering of the beam is possible in the same fashion by joining or separating antenna radiator elements to pathways leading to transmission equipment.

Using the disclosed radiator element herein, singularly or in an array such as in the disclosed modular kit herein, yields highly customizable antennas which may be literally manufactured in the field from an inventory of horizontal and vertical board members with differing numbers of antenna radiator elements, which are carried in a vehicle.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the pioneering conception of such a radiator element formed on a substrate and with a cavity between two halves to yield a wide RF band coverage, and used singularly or in combination in the kit-like component method to form an array, upon which this disclosure is based, may readily be utilized as a basis for designing of other antenna structures, methods and systems for carrying out the several purposes of the present disclosed device. It is important, therefore, that the claims be regarded as including such equivalent construction and methodology insofar as they do not depart from the spirit and scope of the present invention.

It is one principal object of this invention to provide an antenna radiator element which transmits and receives radio waves across a wide array of frequencies, in a single element, and therefor eliminates the need for other differently shaped or lengthened elements.

It is an object of this invention to provide an antenna that may be constructed in an array of individual elements formed in modular components, to yield transmission and reception frequencies which are highly customizable by engaging kits of antenna elements.

It is an additional object of this invention to provide such a modular antenna wherein the gain may be increased or decreased by combining or separating adjacent respective horizontal and vertically disposed antenna elements.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF DRAWING FIGURES

DETAILED DESCRIPTION OF THE PREFERRED EMBODIMENTS OF THE INVENTION

Figure 1:
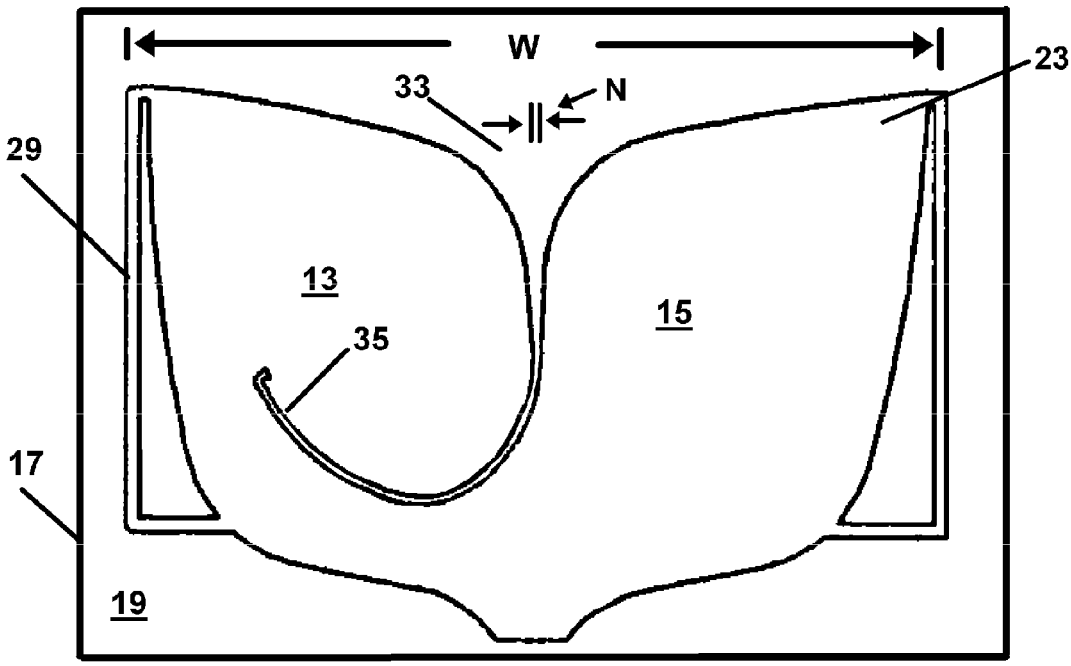
FIG. 1 depicts a top plan view of the preferred mode of the radiator element herein shaped similarly to a "whale tail" positioned on a substrate showing the distal points forming the widest point of the cavity "W" which narrows to a narrowest point "N" at a position substantially equidistant between the two distal points.
Figure 2:
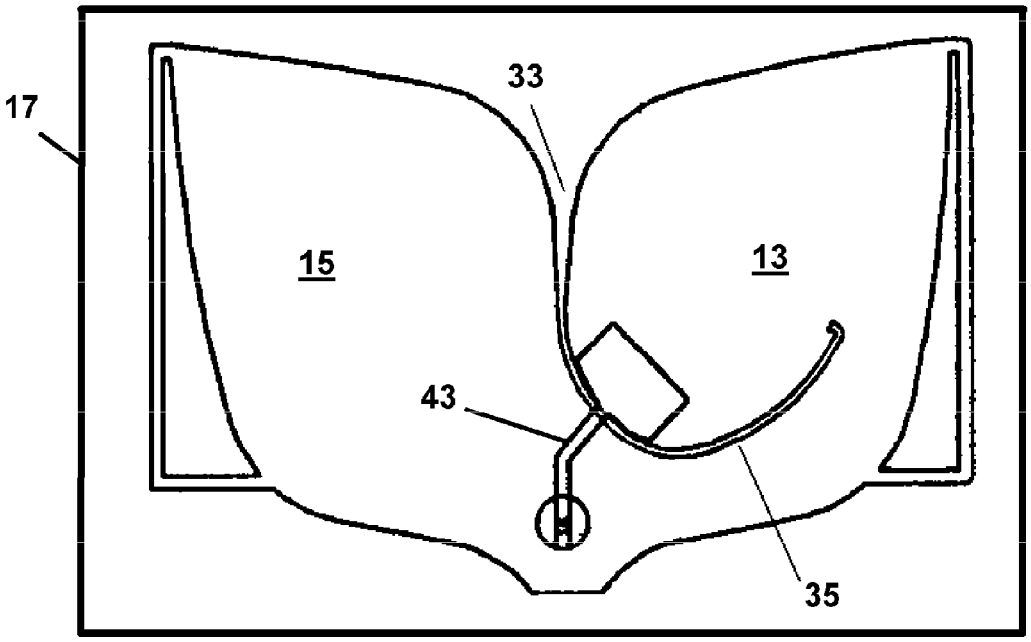
FIG. 2 depicts a rear side of the planar substrate on which the radiator element is mounted showing the feedline engaging a half portion of the radiator element at a tap.
Figure 3:
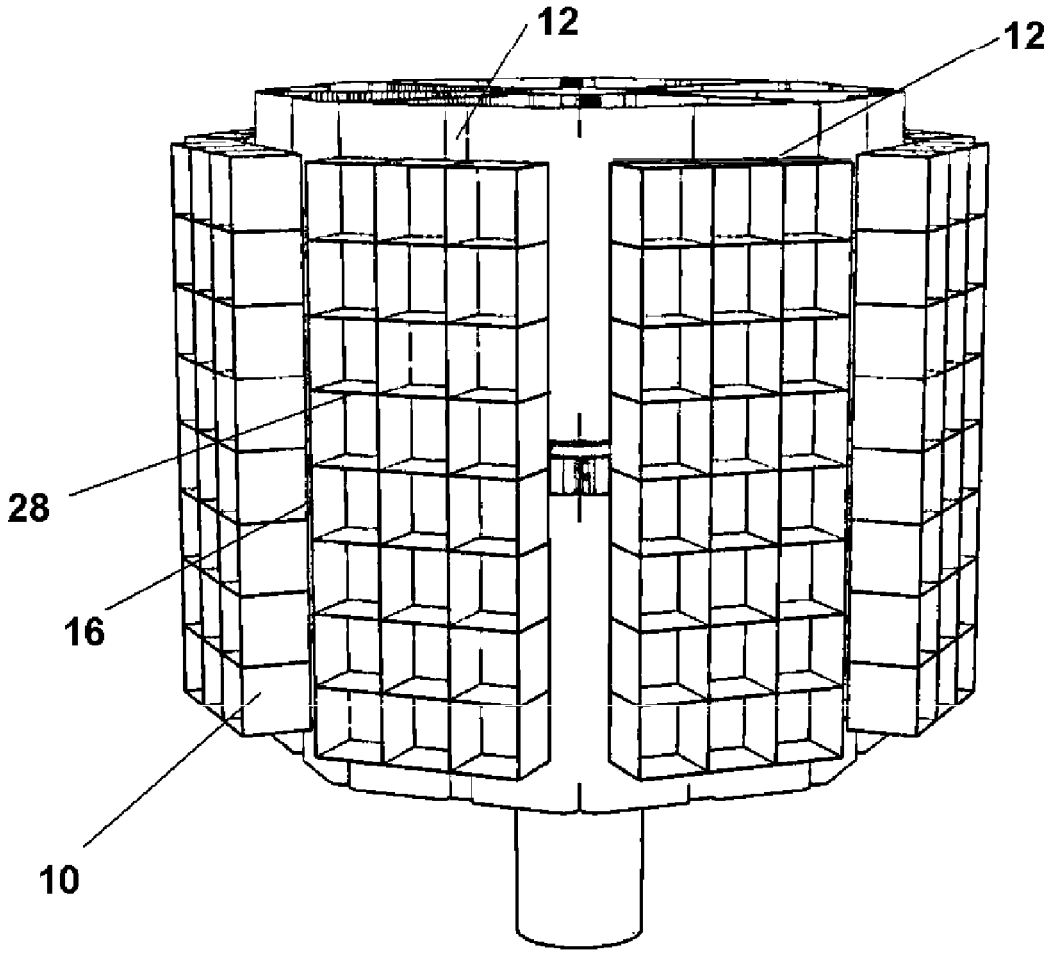
FIG. 3 depicts a tower having arrays of the radiator elements for increased gain, polarization, and beam steering.

Referring now to the drawings of FIGS. 1-10,in FIGS. 1 and 2, depicting the radiator element 22 of the device 10, the radiator element 22 shaped much like a "whale tail" is depicted having two halves which are formed by a first horn 13 and second horn 15 looking much like leaves and being substantially identical or mirror images of each other. Each radiator element 22 of the invention is formed on a substrate 17 which as noted is non conductive and may be constructed of either a rigid or flexible material such as, MYLAR, fiberglass, REXLITE, polystyrene, polyamide, TEFLON fiberglass, or any other such material which would be suitable for the purpose intended.

A first surface 19 is coated with a conductive material by microstripline or the like or other metal and substrate construction well known in this art. Any means for affixing the conductive material to the substrate is acceptable to practice this invention. The conductive material 23 as for example, include but are not limited to aluminum, copper, silver, gold, platinum or any other electrical conductive material which is suitable for the purpose intended. As shown in FIG. 1 the surface conductive material 23 on first surface 19 is etched away, removed by suitable means, or left uncoated in the coating process to form the first and second horns and having a mouth 33 leading to a curvilineal cavity 35. Optionally but preferred mirrored "L" shaped extensions 29 extend from those tips 31 to a connection at the lower points of respective horns 13 and 15. The extensions 29 have been found to significantly enhance performance of the antenna radiator element device 10 at lower frequency ranges of the noted frequencies above.

The cavity 35 extending from the mouth 33 has a widest point "W" and extends between the curved side edges of the two horns 13 and 15 to a narrowest point "N" which is substantially equidistant between the two distal tips 31 and which is positioned along an imaginary line substantially perpendicular the line depicting the widest point "W" running between the two distal tips 31 on the two horns 13 and 15.

The widest distance "W" of the mouth 33 portion of the cavity 35 running between the distal end points 21 of the radiator halves or horns 13 and 15, determines the to low point for the frequency range of the device 10. The narrowest distance "N" of the mouth 33 portion of the cavity 35 between the two horns 13 and 15 determines the highest frequency to which the device 10 is adapted for use. Currently the widest distance "W" is between 1.4 and 1.6 inches with 1.5812 inches being a particularly preferred widest distance "W". The narrowest distance "N" is between 0.024 and 0.026 inches with 0.0253 being particularly preferred when paired with the 1.5812 widest distance "W". Of course those skilled in the art will realize that by adjusting the widest and narrowest distances of the formed cavity, the element may be adapted to other frequency ranges, and any antenna element which employs two substantially identical leaf portions to form a cavity therebetween with maximum and minimum widths is anticipated within the scope of the claimed device herein.

The cavity 35 proximate to the narrowest distance "N" then curves into the body portion of the first horn 13 and extends away from the other horn 15. The cavity 35 extends to a distal end 37 within the first horn 13 where it makes a short right angled extension 41 away from the centerline of the curving cavity 35 and toward the centerline of the mouth 33. This short angled extension 41 has shown improvement in gain for some of the frequencies.

On the opposite surface of the substrate 17 shown in FIG. 2, a feedline 43 extends from the area of the cavity 35 intermediate the two horns 13 and 15 forming the two halves of the radiator element 22 and passes through the substrate 17 to electrically connect to the first horn 13 adjacent to the edge of the curved portion of the cavity 25 past the narrowest distance "N".

The location of the feedline 43 connection, the size and shape of the two horns 13 and 15, of the radiator element 22, and the crossectional area of the widest distance "W" and narrowest distance "N" of the cavity 35, may be of the antenna designers choice for best results for a given use and frequency. However because of the disclosed radiator element 22 performs so well and across such a wide bandwidth, the current mode of the radiator element 22 as depicted herein, with the connection point shown, is especially preferred.

The radiator element 22 maintaining substantially the same "whale tail" appearance when viewed from above, may be adapted in dimension to optimize it for other RF frequencies between a maximum low frequency and maximum high frequence and those that fall therebetween. This may be done by forming said lobes 13 and 15 to position the distal tips 31 at a widest point "W", which is substantially one quarter or one half the distance of the length of an RF wave radiating at the maximum low frequency desired. To determine the maximum high frequency for the radiator element 22, it would be formed with a narrowest point "N" of the mouth having a distance which is substantially one half or one quarter the distance of the length of the RF wave radiating at the highest frequency desired. This may be done by adjusting the curved edges of the lobes 12 and 15 slightly to accommodate the narrower or wider narrowest point "N". Once so formed, the radiator element 22 will receive and transmit well on all frequencies between the maximum high and low frequencies.

Because of this unique shape providing the radiator element 22 a transmit and receiving ability across many frequencies, each such radiator element 22 is easily combined with others of identical shape, to form an array to increase gain and steer the beam of the formed antenna. Using switching means run by software adapted to the task, the connected radiator elements 22 may function in a horizontal polarization, vertical polarization, or circular polarization and may be joined, or employed separately to communicate with other such radiator elements 22 remote antennas formed in the same fashion.

As noted, the device 10 may be employed in a modular fashion as in FIGS. 4-10, by forming the radiator elements 22 on substrates 17 which form base members 16 and secondary base members 17, each of which are configured with electrical pathways 18 terminating at connector points 20 to communicate between the engageable antenna radiator elements 22, and a transmitter, receiver, or transceiver.

One or a plurality of the base members 16 and secondary base members 17 are arranged in parallel and provide slots 24 as a means 20 for frictional connection with the traverse horizontal board members 28 on which antennas or antenna radiator elements are positioned. The base members 16 may also have antenna radiator elements 22 positioned thereon.

The slots 24 in the base members 16 and the secondary base members 17 are sized to engage with notches 34 in the horizontal board members 28. Engaging the slots 24 with the notches 34 will 12 automatically align the horizontal board members 28 carrying the antenna radiator elements 22 with the connector points 36 on the secondary base members 17 engaging the radiator elements 22 with the electrical pathways 18 on the secondary base members 17. The horizontal board members 28 may have antenna radiator elements 22 formed or engaged thereon.

The secondary board members having electrical pathways 18 thereon leading to mating connection points 35 at the notches 34 such that engaging the secondary base member 17 can connect all of the horizontal antenna radiator elements 22 to the connectors 20 leading to the radio equipment individually, or combined depending on the formation of the pathways 18 and number of terminating connectors 20.

Thus gain may be increased by pathways combining radiator elements 22 or, frequency numbers may be increased by providing pathways 18 that provide separate communications of individual radiator elements 22 to a transceiver. The device may be formed into an array of vertically disposed radiator elements 22 and/or horizontally disposed radiator elements 22 to increase gain or use a horizontal, vertical, or circular polarization scheme. A ground plane 40 on a substrate, is provided in such an array formation also having slots therein, to allow communication of the horizontal board members 18 through 20 the ground plane 40 and a rear connection of the secondary base members 17 to the aligned notches 34.

Figure 4:
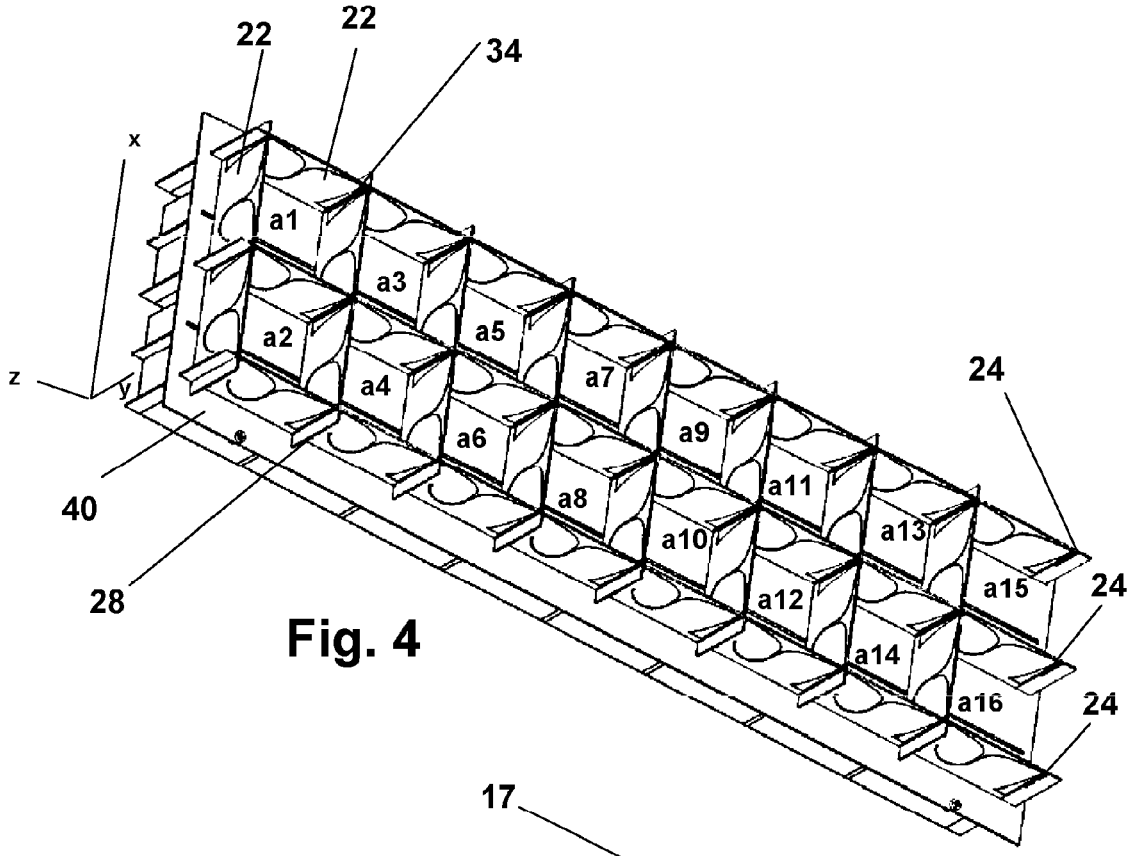
FIG. 4 depicts a modular array antenna formed of the elements herein showing the rectangular cavities having antenna elements therein in horizontal and vertical dispositions.
Figure 5:
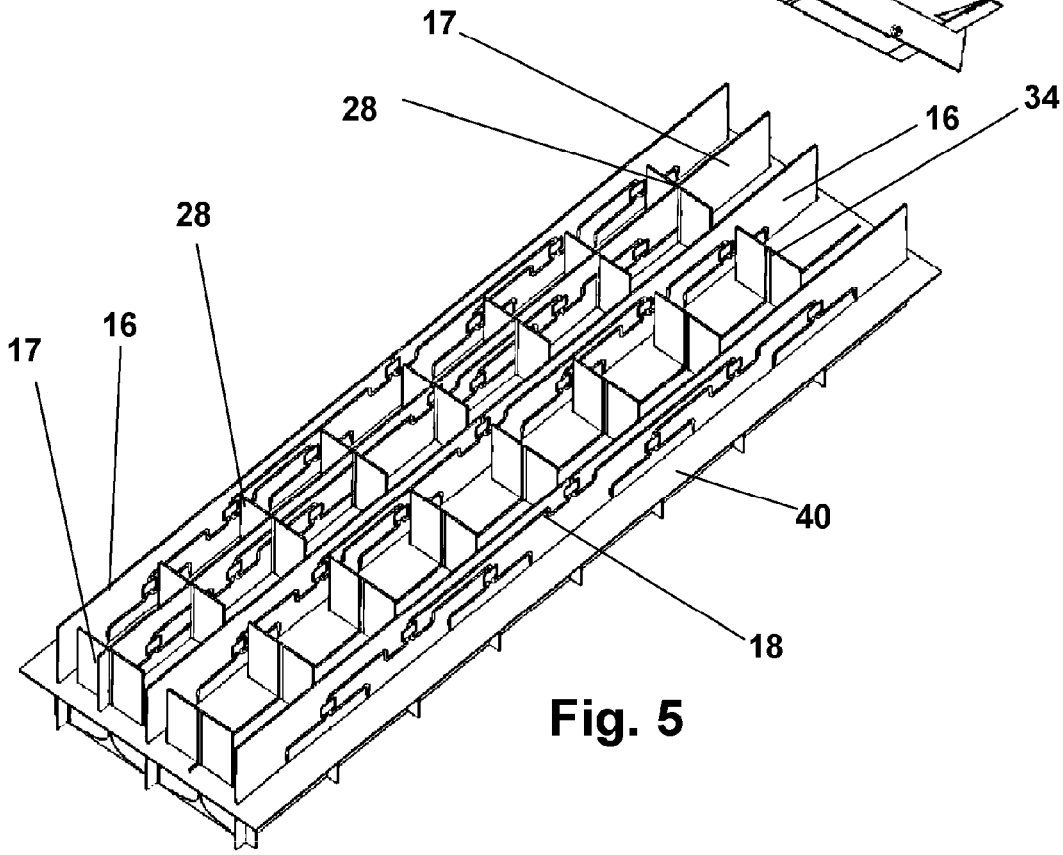
FIG. 5 is a rear perspective view of FIG. 4 showing the pathways on the base members adapted to engage traverse or horizontal members.
Figure 6:
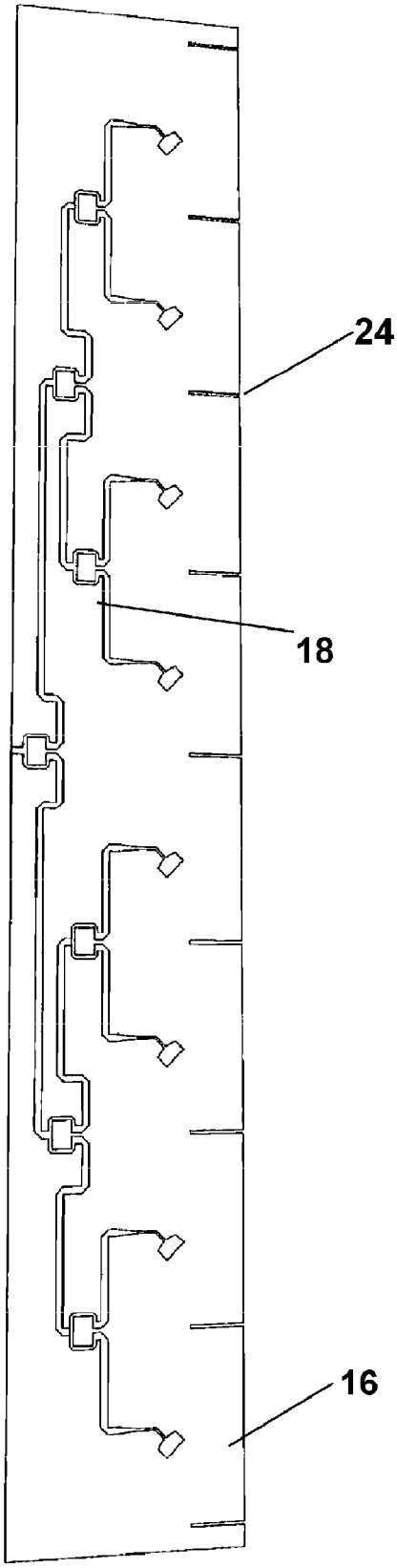
FIG. 6 shows the rear of the device in FIG. 7 and the electrical pathways formed on the substrate communicating with taps to the antenna elements on the opposite side.
Figure 7:
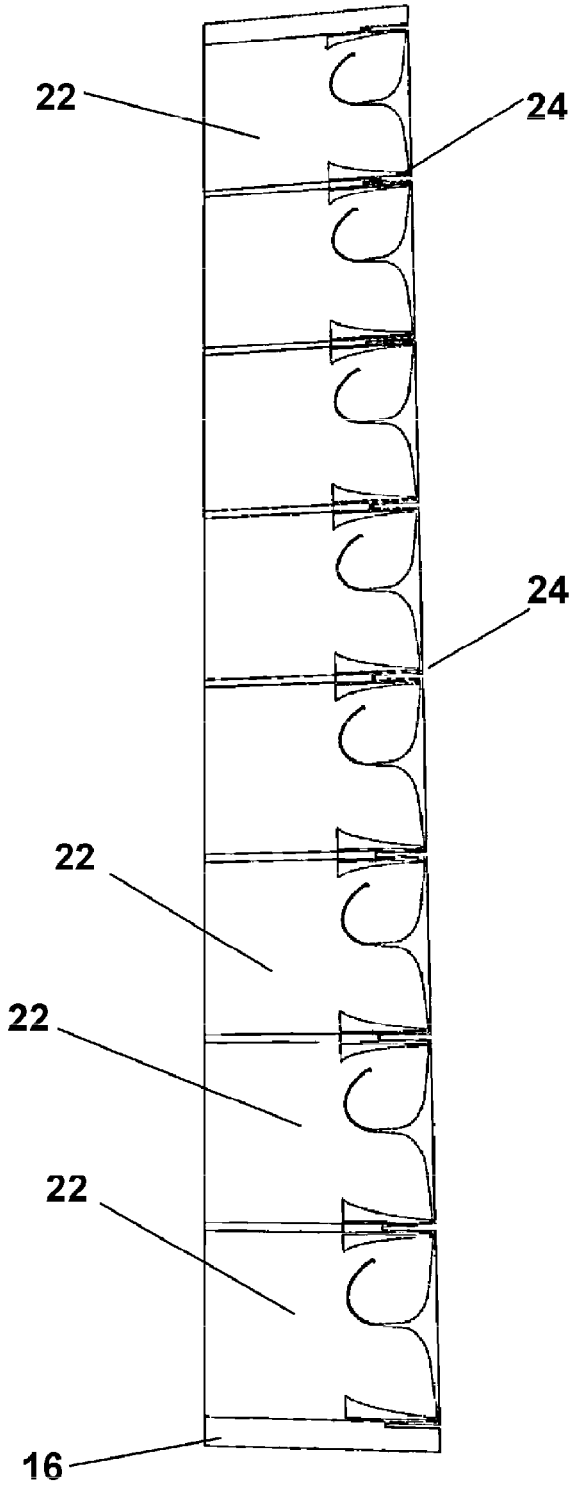
FIG. 7 depicts a base member of FIG. 6 with a plurality of individual antenna elements formed thereon.
Figure 8:
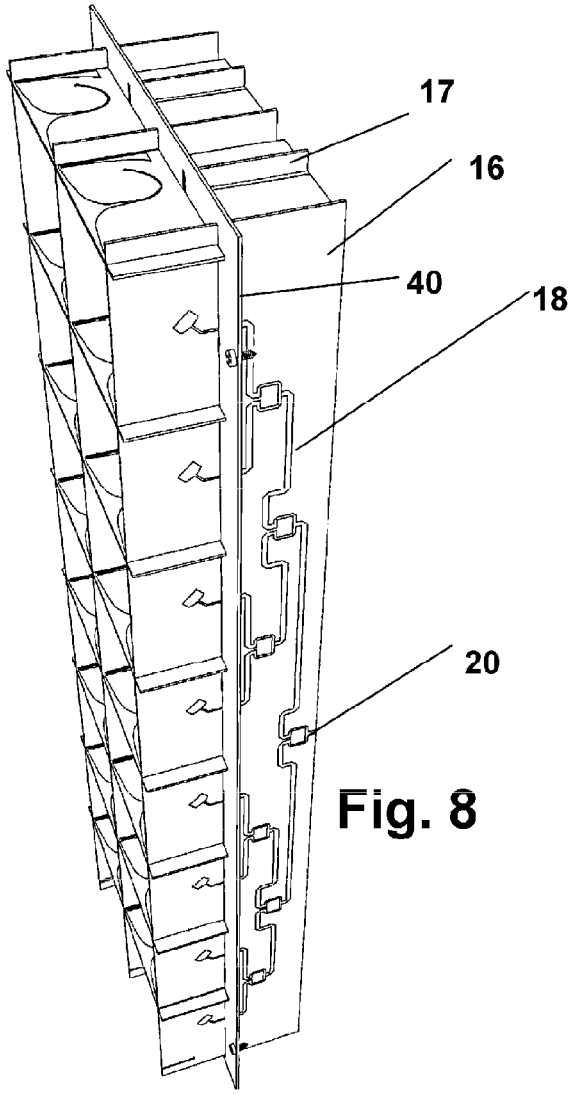
FIG. 8 shows a side view of the device of FIGS. 4-5 and the pathways formed thereon to communicate between antenna elements and transceivers, receivers, or other components.
Figure 9:
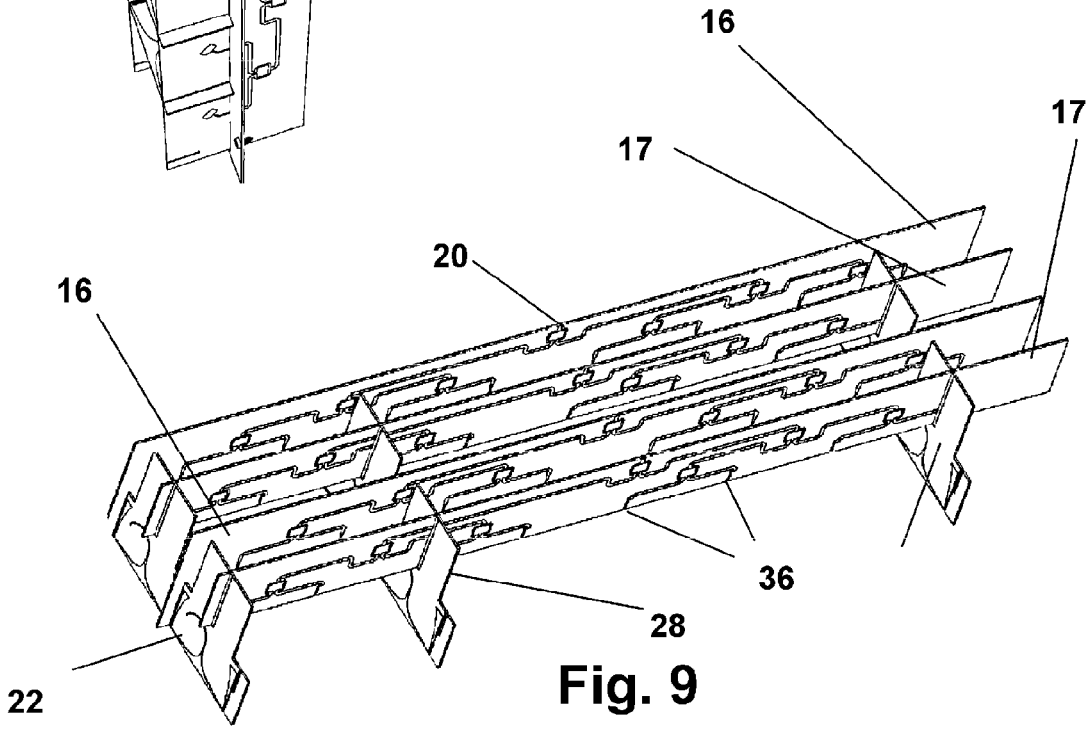
FIG. 9 depicts the device wherein the horizontal members are being engaged with the vertical or base members in a registered engagement enabling frictional or other electrical coupling of electrical pathways easily.
Figure 10:
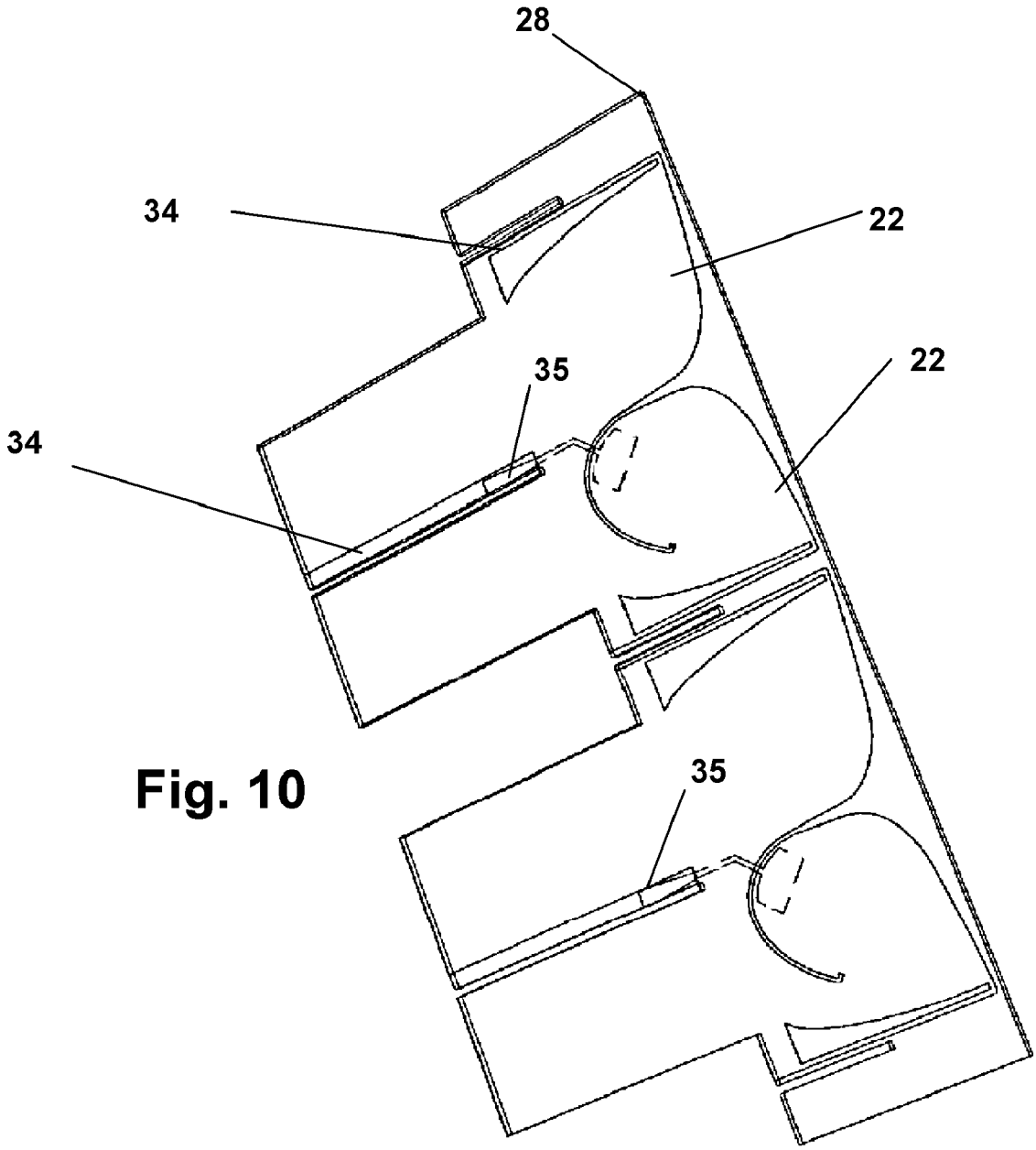
FIG. 10 depicts a horizontal member with adapted to engage slots in the vertical members and the disclosed particularly preferred "whale tail" element configuration.

The formed array antenna of individual radiator elements 22 will resemble a sorting bin and have a plurality of adjacent rectangular cavities such as shown in FIG. 4 where the employment of pathways 18 on the base members 16 and secondary members 18 to combine adjacent parallel radiator elements 22 such as those in AI-A2, will yield increased gain, and increasing power to the horizontally disposed radiator elements 22 allows for angle changes A-B shown in FIG. 1 for the transmission and reception beam.

Of course the connections noted herein as being frictional can be hard wired, or otherwise wired and electrically connected as needed and in some cases this may be preferable. Switching means to combine or separate individual radiator elements 22 to increase or decrease the array gain, or to increase individual transmission pathways between like radiator elements 22 on other towers, would best be handled electronically by a computer and software monitoring system needs based on users within range of the tower housing the antennas formed of the radiator elements 22.

Those skilled in the art will realize that such switching will allow each radiator element 22 to be combined with others for increased gain or to be separated to decrease gain. Beam steering may also be changed and the radiator elements 22 may be separated to yield individual horizontal or vertically disposed RF pathways for the transceiver to allow for more individual frequencies and transmission carriers from each such antenna array formed of the switchably engageable array of radiator elements 22 in the differing horizontal and vertical arrangements.

When employed with such software controlled electronic switching in towers of such radiator elements 22 forming antennas in a grid, the device thus forms a phased array antenna configuration providing concurrent multiple band high capacity communications between towers in the grid and users on the ground. Concurrently the antenna provides for a steering of beam width and angles to users on the ground to form optimal tower-footprint for communications in a grid.

While all of the fundamental characteristics and features of the imposed radiator element and modular assembly thereof have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A radiator element comprising:

a substrate;

a first substrate surface, a portion of which is covered with a conductive material, and a portion of which is uncovered;

said conductive material forming a pair of horns having substantially identical shapes, said horns each extending in opposite directions to distal tips;

said pair of horns having substantially identical shapes, extending in opposite directions to distal tips having the appearance of a whale's tail when viewed from a position normal to said first substrate surface;

a first cavity formed by said uncovered portion in-between said pair of horns;

said first cavity having a mouth portion, said mouth portion beginning at a first edge along a line extending between said distal tips;

said mouth portion reducing in cross-section as it extends from said first edge from a widest point substantially in-between said distal tips, to a narrowest point in between said pair of horns;

said first cavity extending away from said narrowest point in a curved direction into a first one of said horns; and a feedline electrically communicating at a first end with a second one of said horns and adapted at a second end for electrical communication with an RF receiver or transceiver.

2. The radiator element of claim 1, further comprising:

said narrowest point being at a position substantially equidistant from both said distal tips;

said position of said narrowest point being substantially along a line running perpendicular to said first edge.

3. The radiator element of claim 2, further comprising:

said widest point being between 1.4 and 1.6 inches; and said narrowest point being between 0.024 and 0.026 inches.

4. The radiator element of claim 2, further comprising:

said widest point being substantially 1.5812 inches; and said narrowest point being 0.0253 inches.

5. The radiator element of claim 1, further comprising:

said widest point being between 1.4 and 1.6 inches; and said narrowest point being between 0.024 and 0.026 inches.

6. The radiator element of claim 1, further comprising:

said widest point being substantially 1.5812 inches; and said narrowest point being 0.0253 inches.

7. The radiator element of claim 1, further comprising:

a plurality of said radiator elements formed on said substrates adjacent to each other forming a said substrate with multiple said radiator elements;

a plurality of said substrate with said multiple radiator elements engageable to each other to form an array and position said radiator elements perpendicularly disposed to each other;

means to electrically connect said radiator elements in said array which are in a horizontally disposed positioning; and electrically connecting said horizontally disposed radiator elements thereby providing a gain in RF signals which are horizontally disposed; and electrically connecting said vertically disposed radiator elements thereby providing a gain in RF signals which are vertically disposed.

8. A method of adapting a wideband radiator element of claim 1 to radiate and receive RF signals between a maximum high and a maximum low frequency and adapted to transmit and receive RF frequencies therebetween, comprising:

forming lobes defining said horns to position said distal tips at said widest point, said widest point being a distance which is substantially half the distance of the length of a wave radiating at said low frequency; and forming lobes defining said horns to form said narrowest point of said mouth having a distance which is substantially one half the distance of the lengths of a wave radiating at said high frequency.

9. A method of adapting a wideband radiator element of claim 1 to radiate and receive RF signals between a maximum high and a maximum low frequency and adapted to transmit and receive RF frequencies therebetween, comprising:

forming lobes defining said horns to position said distal tips at said widest point, said widest point being a distance which is substantially one quarter the distance of the length of a wave radiating at said low frequency; and forming lobes defining said horns to form said narrowest point of said mouth having a distance which is substantially one quarter of the distance of a wave radiating at said high frequency.

10. A radiator element comprising:

a substrate;

a first substrate surface, a portion of which is covered with a conductive material, and a portion of which is uncovered;

said conductive material forming a pair of horns having substantially identical shapes, said horns each extending in opposite directions to distal tips;

a first cavity formed by said uncovered portion in-between said pair of horns;

said first cavity having a mouth portion, said mouth portion beginning at a first edge along a line extending between said distal tips;

said mouth portion reducing in cross-section as it extends from said first edge in-between said two horns to a narrowest point in between said pair of horns;

said first cavity extending away from said narrowest point in a curved direction into a first one of said horns;

a feedline electrically communicating at a first end with a second one of said horns and adapted at a second end for electrical communication with an RF receiver or transceiver;

a pair of "L" shaped conductors extending from each respective said distal tip of said horns; and each respective said conductor electrically communicating between a respective said distal tip of one said horn and a respective body portion of the same said horn from which it extends.

11. A radiator element comprising:

a substrate;

a first substrate surface, a portion of which is covered with a conductive material, and a portion of which is uncovered;

said conductive material forming a pair of horns having substantially identical shapes, said horns each extending in opposite directions to distal tips;

a first cavity formed by said uncovered portion in-between said pair of horns;

said first cavity having a mouth portion, said mouth portion beginning at a first edge along a line extending between said distal tips;

said mouth portion reducing in cross-section as it extends from said first edge in-between said two horns to a narrowest point in between said pair of horns;

said first cavity extending away from said narrowest point in a curved direction into a first one of said horns;

a feedline electrically communicating at a first end with a second one of said horns and adapted at a second end for electrical communication with an RF receiver or transceiver;

said narrowest point being at a position substantially equidistant from both said distal tips;

said position of said narrowest point being substantially along a line running perpendicular to said first edge;

a pair of "L" shaped conductors extending from each respective said distal tip of said horns;

each respective said conductor electrically communicating between a respective said distal tip of one said horn and a respective body portion of the same said horn from which it extends.

12. The radiator element of claim 11, further comprising:

said widest point being between 1.4 and 1.6 inches; and said narrowest point being between 0.024 and 0.026 inches.

13. The radiator element of claim 11, further comprising:

said widest point being substantially 1.5812 inches; and said narrowest point being 0.0253 inches.

* * * * *